US007278416B2

(12) United States Patent
Larcheveque et al.

(10) Patent No.: US 7,278,416 B2
(45) Date of Patent: Oct. 9, 2007

(54) PNEUMATIC PROJECTILE LAUNCHER AND SONOBUOY LAUNCHER ADAPTOR

(75) Inventors: Jon F. Larcheveque, Owego, NY (US); Jan M. Nielsen, Glen Aubrey, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 96 days.

(21) Appl. No.: 11/311,941

(22) Filed: Dec. 19, 2005

(65) Prior Publication Data

US 2006/0213492 A1 Sep. 28, 2006

Related U.S. Application Data

(60) Provisional application No. 60/638,650, filed on Dec. 22, 2004.

(51) Int. Cl.
*F41B 11/06* (2006.01)

(52) U.S. Cl. ..... 124/72; 89/1.51

(58) Field of Classification Search ..... 89/1.51; 124/56, 72

See application file for complete search history.

(56) References Cited

U.S. PATENT DOCUMENTS

| | | | |
|---|---|---|---|
| 3,786,403 | A | 1/1974 | Will et al. |
| 3,905,291 | A | 9/1975 | Corbin, Jr. |
| 4,026,188 | A | 5/1977 | Woodruff et al. |
| 4,164,887 | A | 8/1979 | Ouellette |
| 4,263,835 | A | 4/1981 | Dragonuk |

(Continued)

OTHER PUBLICATIONS

Bae Systems, Aircraft Deployed Tactical DropSonde, www.ids.na.baesystems.com/MADS/Products/dropsonde, date unknown.

The Ordance Shop, MK 25 Mods 2 and 3 Marine Locator, www.ordance.org/MK25.htm, date unknown.

(Continued)

*Primary Examiner*—Troy Chambers
*Assistant Examiner*—Stewart T Knox
(74) *Attorney, Agent, or Firm*—Louis J. Franco; Leland D. Schultz; Patrick M. Hogan

(57) ABSTRACT

A pneumatic sonobuoy launcher adapted for simultaneously storing, and sequentially and independently launching, at least two sonobuoys includes a barrel with a closed back end, an expulsion end opposite the back end and an interior sonobuoy-guiding channel extending between the opposed ends. The channel is adapted for storing a series of sonobuoys including rearwardmost and forwardmost sonobuoys stored, respectively, closest to the back end of the barrel and closest to the expulsion end of the barrel. Each stored sonobuoy occupies a distinct region of the channel separated by an interval from at least one other region. An expulsion-gas delivery system includes at least one valve that is selectively connectable into fluid communication with an expulsion-gas supply and is pneumatically switchable from at least (i) a first gas-channeling state in which expulsion gas introduced through the valve is directed to a first interval between sonobuoys to (ii) a second gas-channeling state in which expulsion gas introduced into the valve is directed to at least one of (a) a second interval located to the rear of the first interval and (b) a location within the channel behind the rearwardmost sonobuoy. A feedback conduit communicates pneumatic back pressure created upon the expulsion of a sonobuoy to the switchable valve in order to switch the valve from the first gas-channeling state to the second gas-channeling state for the launch of a subsequent sonobuoy.

8 Claims, 7 Drawing Sheets

U.S. PATENT DOCUMENTS

| | | | | | |
|---|---|---|---|---|---|
| 4,372,239 | A | | 2/1983 | Hagelberg et al. | |
| 4,444,085 | A | | 4/1984 | Dragonuk | |
| 4,733,597 | A | | 3/1988 | Upham | |
| 4,927,396 | A | | 5/1990 | Wood | |
| 5,052,270 | A | | 10/1991 | Travor et al. | |
| 5,054,364 | A | | 10/1991 | Dragonuk, deceased et al. | |
| 5,063,823 | A | * | 11/1991 | Marshall et al. | 89/1.51 |
| 5,070,760 | A | | 12/1991 | Marshall et al. | |
| 5,076,134 | A | * | 12/1991 | Marshall et al. | 89/1.51 |
| H1025 | H | * | 3/1992 | Dragonu et al. | 89/1.51 |
| 5,092,221 | A | * | 3/1992 | Travor et al. | 89/1.51 |
| 5,155,288 | A | | 10/1992 | Marshall et al. | |
| 5,160,101 | A | | 11/1992 | Ferraro et al. | |
| 5,160,800 | A | | 11/1992 | Travor et al. | |
| 5,222,996 | A | | 6/1993 | Marshall et al. | |
| 5,339,288 | A | | 8/1994 | Blier et al. | |
| 5,343,849 | A | * | 9/1994 | Steer | 124/72 |
| 5,359,917 | A | | 11/1994 | Travor | |
| 5,442,358 | A | | 8/1995 | Keeler et al. | |
| 5,456,427 | A | * | 10/1995 | Greenhalgh | 244/138 R |
| 5,566,908 | A | | 10/1996 | Greenhalgh | |
| 5,973,994 | A | | 10/1999 | Woodall | |
| 6,056,237 | A | | 5/2000 | Woodland | |
| 6,082,675 | A | | 7/2000 | Woodall, Jr. et al. | |
| 2002/0196707 | A1 | | 12/2002 | Kitchin et al. | |

* cited by examiner

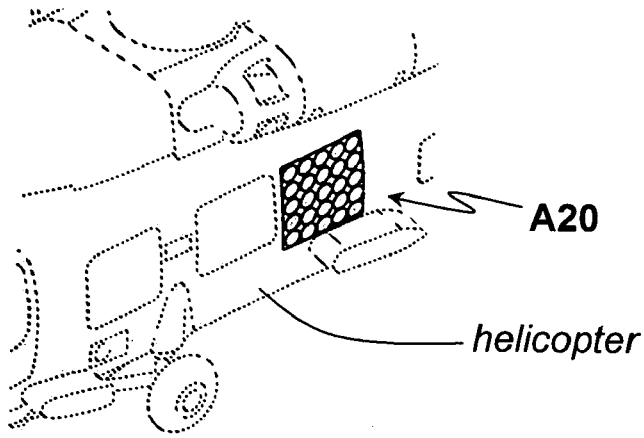
FIG. A
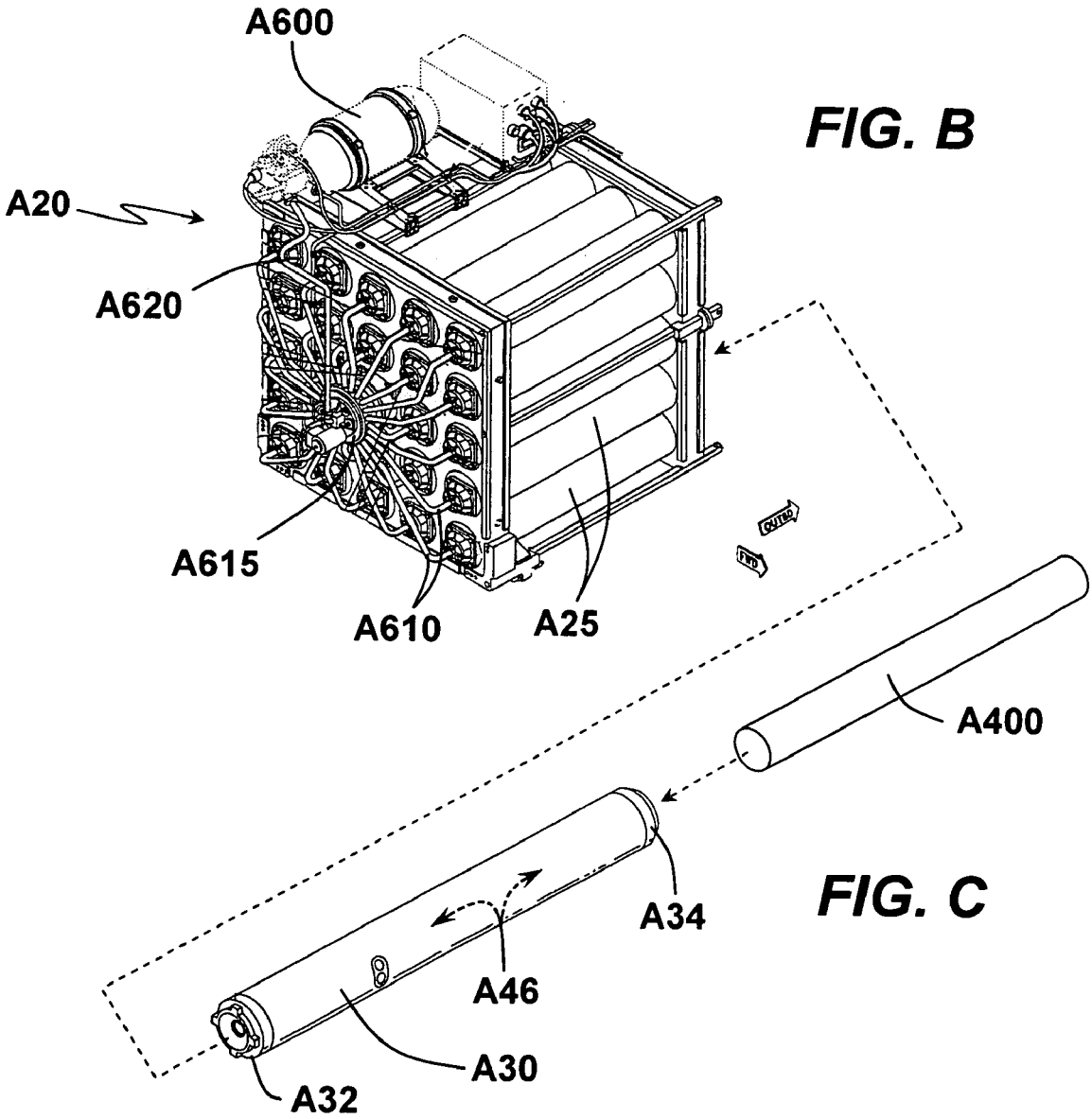
FIG. B
FIG. C

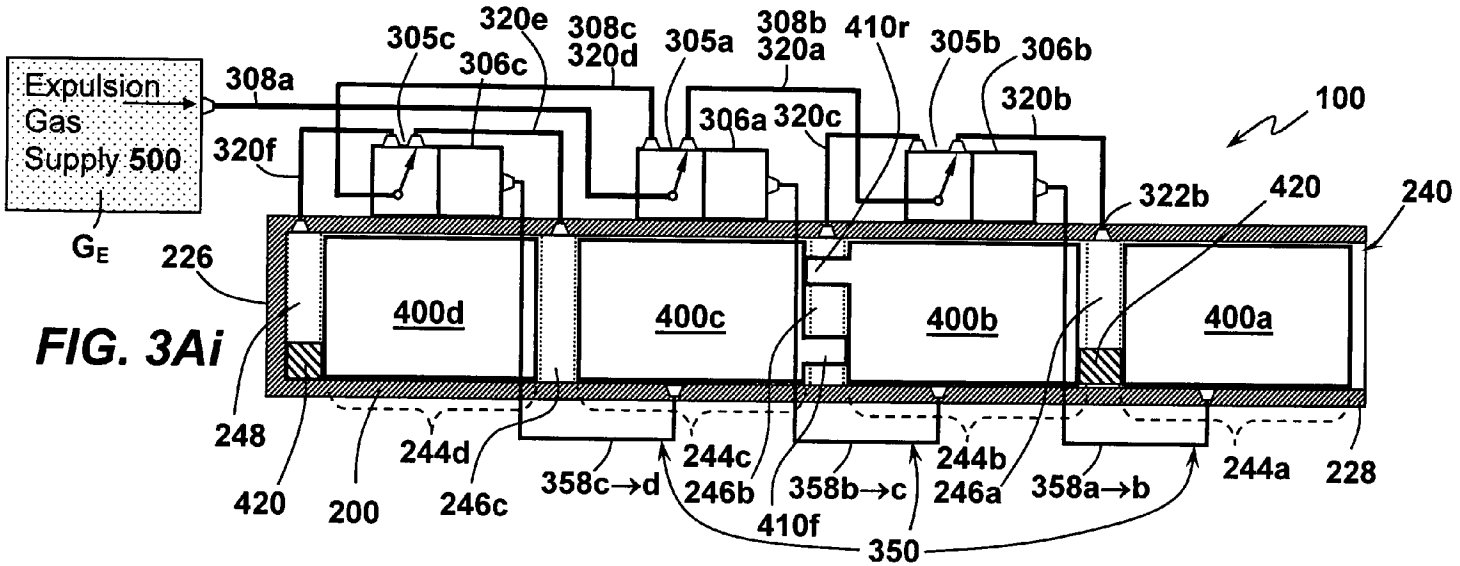
FIG. 3Ai
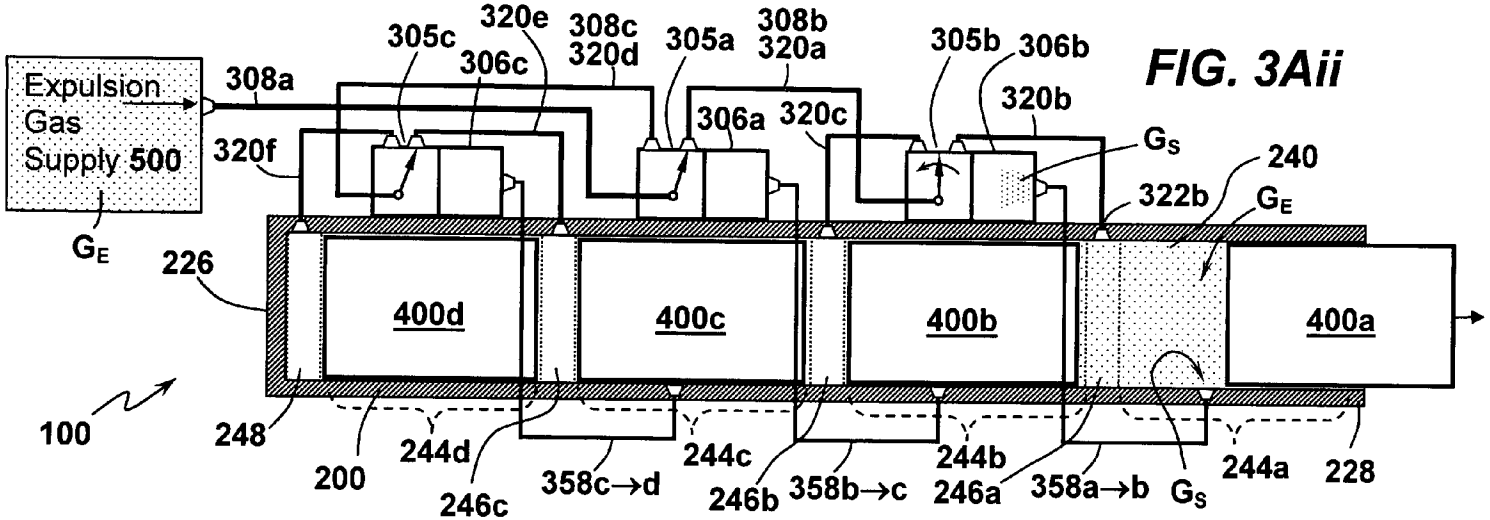
FIG. 3Aii

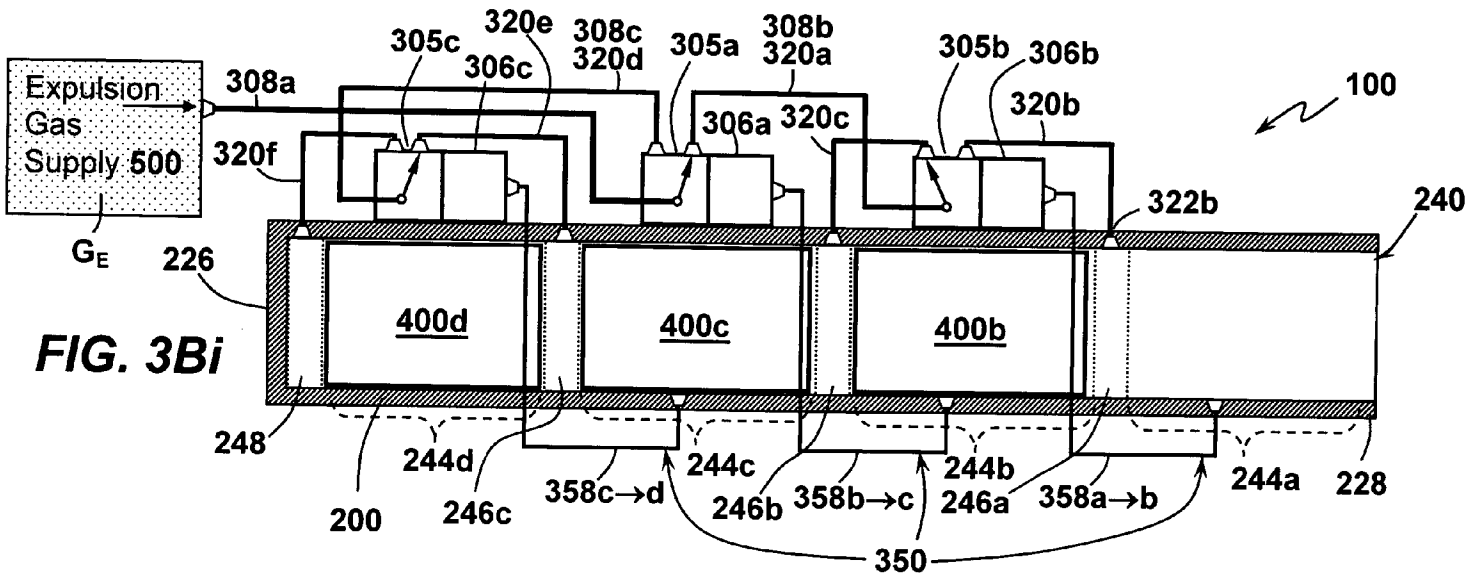
FIG. 3Bi
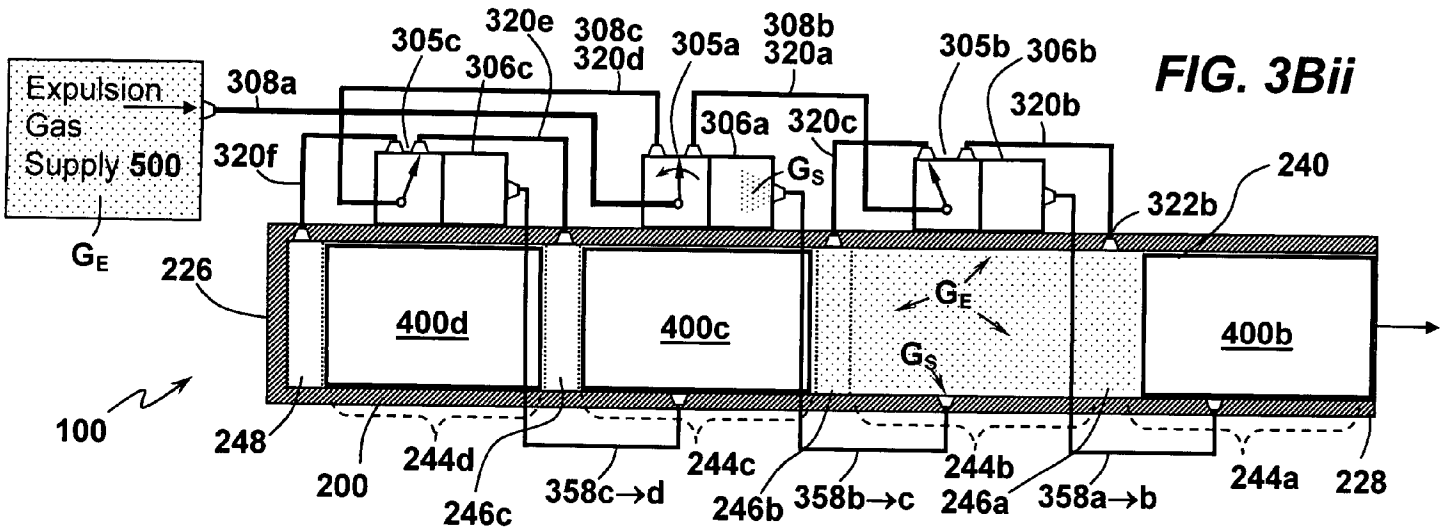
FIG. 3Bii

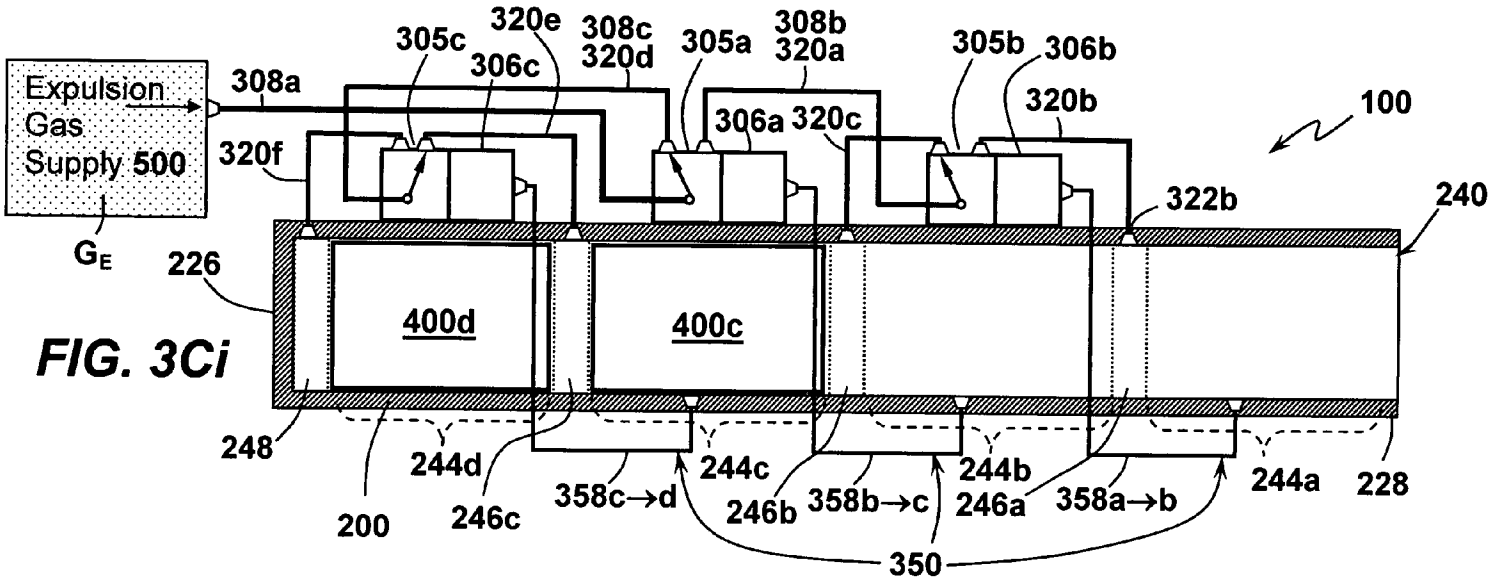
FIG. 3Ci
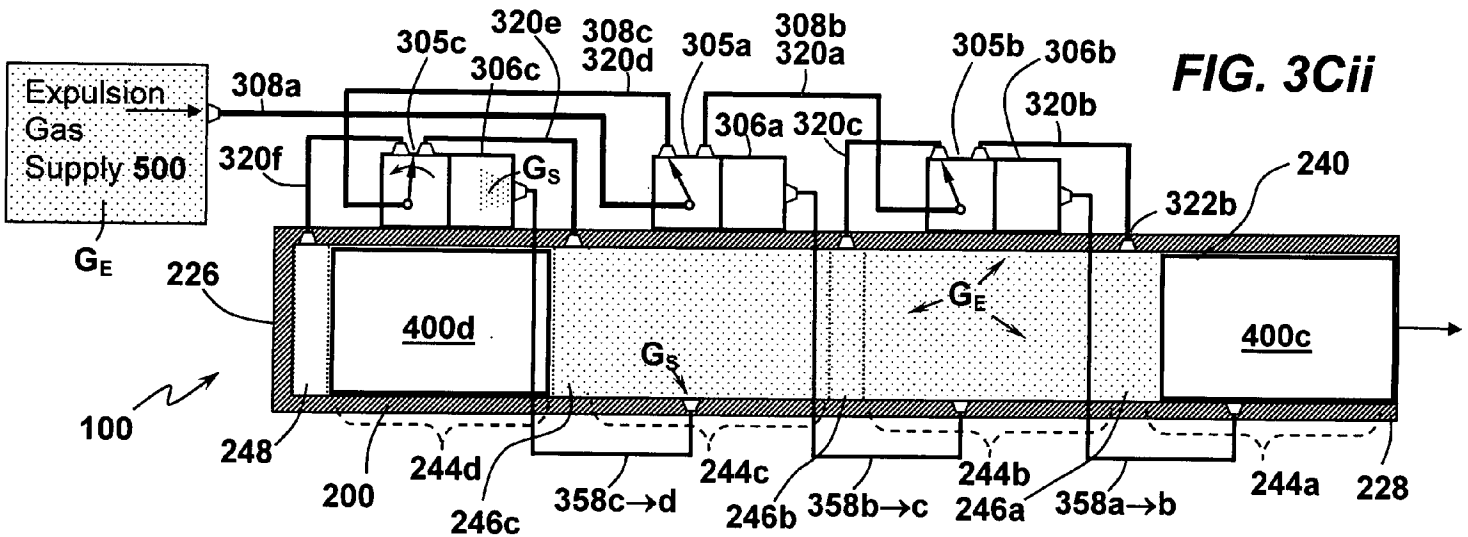
FIG. 3Cii

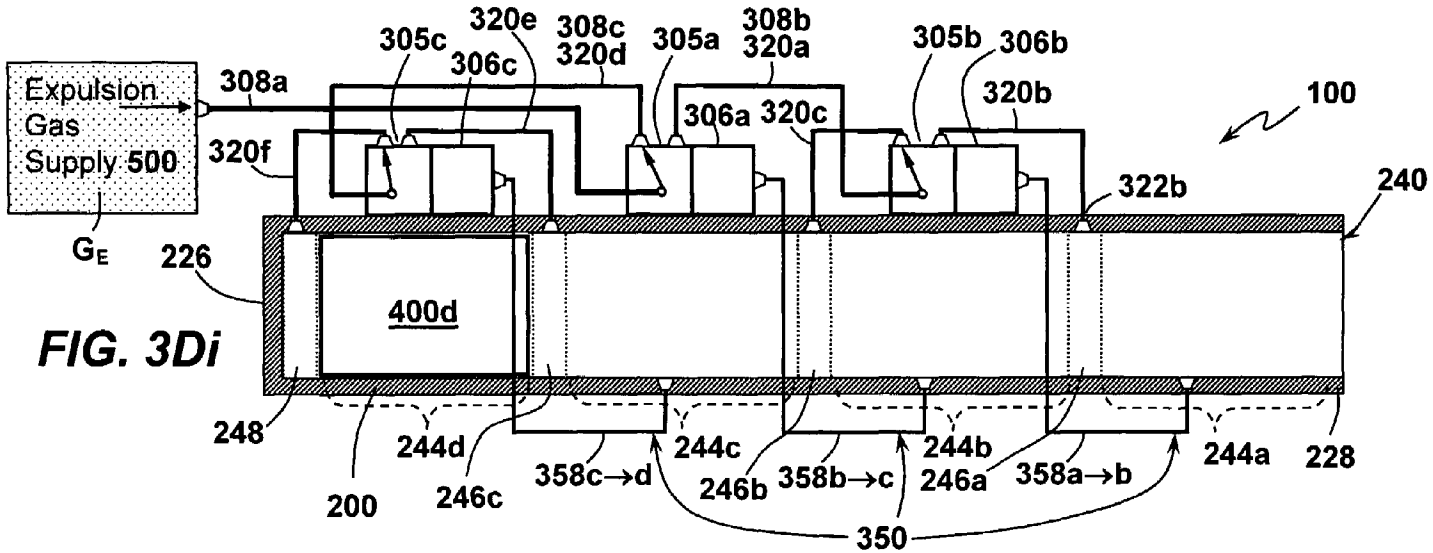
FIG. 3Di
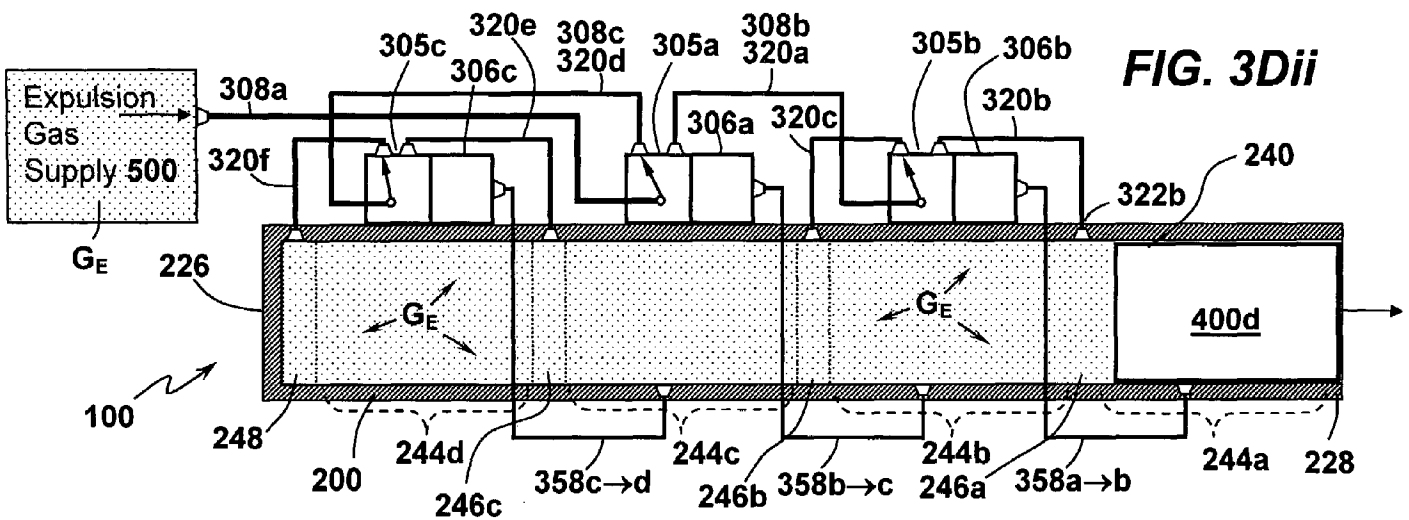
FIG. 3Dii

PNEUMATIC PROJECTILE LAUNCHER AND SONOBUOY LAUNCHER ADAPTOR

PROVISIONAL PRIORITY CLAIM

Priority based on Provisional Application Ser. No. 60/638,650, filed Wednesday, Dec. 22, 2004, and entitled "PNEUMATIC PROJECTILE LAUNCHER AND SONOBUOY LAUNCHER ADAPTOR," is claimed.

BACKGROUND

1. Field

Although not so limited in its utility or scope, implementations of the present invention are particularly well suited for the deployment of sonobuoys, such as Light Weight Sound System (LWSS) buoys from aircraft and, more particularly, to apparatus for retrofitting existing single-buoy launch tubes in order to enable sequential, pneumatic deployment of multiple sonobuoys from the retrofitted launch tube.

2. Brief Description of Illustrative Environments and Related Art

Existing multi-sonobuoy launch systems are of generally two configurations. A first configuration is characterized by an array of launch tubes each of which launch tubes is dedicated to the storage and, when activated, ejection of a single sonobuoy. FIGS, A, B and C represent an existing array-type sonobuoy launcher A20 and a typical environment in which such a system is carried. More specifically, FIG. A shows an array-type sonobuoy launcher A20 carried in the side of an aircraft (i.e., a helicopter indicated partially in dashed lines). FIG. B shows the sonobuoy launcher A20 of FIG. A removed from the aircraft, enlarged and rotated to reveal the back side thereof. The sonobuoy launcher A20 includes a fixed array of launch-tube retainers A25 which, in the illustrative example, are cylindrically shaped hollow tubes. Each launch-tube retainer A25 is adapted to removably receive and retain a launch tube such as the launch tube A30 of FIG. C. Each launch tube A30 is adapted to store a single sonobuoy A400 and includes a breech end A32, a sonobuoy-ejection end A34 opposite the breech end A32 and a sonobuoy-retaining cavity A46. When a launch tube A30 is inserted into a launch-tube retainer A25, as indicated by the dashed arrow leading from FIG. C to FIG. B, a gas port A33 at the breech end A32 of the launch tube A30 is selectively connected into gas-tight fluid communication with a source of compressed gas A600 through a dedicated gas conduit A610 corresponding to the launch tube A30. In the example shown, each dedicated gas conduit A610 leads from a gas-distributing plenum A615 that directs gas fed to the plenum A615 from a gas main A620 leading from the gas source A600 to a selected launch tube A30. Gas fed to the beech end A32 of a launch tube A30 expels the sonobuoy A400 contained therein. Once a sonobuoy A400 has been launched, the location in the array-type sonobuoy launcher A20 is "re-loaded" by either (i) removing the "spent" launch tube A30 and inserting a fresh launch tube A30 containing a sonobuoy A400 into the corresponding launch-tube retainer A25 or (ii) inserting a fresh sonobuoy A400 into the launch tube A30 with the launch tube A30 still in place within the launch-tube retainer A25. The representative array-type sonobuoy launcher A20 described in conjunction with FIGS. A, B, and C is merely illustrative of array-type sonobuoy launchers in general and provides a single, non-limiting example of a sonobuoy launcher with which implementations of the invention disclosed and described below in the summary and detailed description may be caused to co-operate in a manner that will be appreciated upon examination of the aforementioned summary and detailed description.

A second general configuration of multi-sonobuoy launch system accommodates the storage and sequential launching of multiple sonobuoys from a single launch tube. Advances in related technological arts, including the miniaturization of electronic circuitry and data storage apparatus, for example, have enabled substantial reduction in the overall sizes of sonobuoys. With a reduction in the sizes of sonobuoys enabled, efforts have been undertaken to modify existing sonobuoy launchers to facilitate the sequential launch of multiple sonobuoys from a launch tube originally designed for the storage and launch of a single sonobuoy.

Various existing launch systems capable of sequentially launching multiple sonobuoys from a single launch tube involve the discharge of a distinct launch mechanism dedicated to the launch of each sonobuoy. The "launch mechanisms" employed have been of various types including reservoirs of compressed gas (e.g., $CO_2$ cartridges) and small, impact-responsive explosive charges, for example. In some cases, a launch mechanism is situated in proximity to the sonobuoy to which it corresponds and activation mechanisms (e.g., electrical circuitry and an electrically-activated squib) are routed to it. In alternative examples, launch mechanisms are situated in relative proximity to one another (e.g., at the breech end of the launch tube) and a distinct gas-flow channel channels the gas generated upon the discharge of a launch mechanism to the rear of the sonobuoy to which that launch mechanism corresponds.

One existing multi-sonobuoy sequential launch system includes a launch tube that connects into a pneumatic air supply port on an aircraft (or other vehicle) to supply pressurized gas (i.e., air) through an opening at the breech end of the launch tube. Although this system harnesses the onboard air supply and obviates electrical activation circuitry, for example, it utilizes the onboard air supply only indirectly in order to activate independent discharge mechanisms. More specifically, the launch tube includes a control module at the breech end and a plurality of distinct gas-flow channels. The control module includes a plenum chamber that is in fluid communication with the onboard air supply. Each gas-flow channel leads from the control module to a unique location along the length of the launch tube and has a distal end, opposite the control module end, in fluid communication with a section of the launch tube situated to the rear of a sonobuoy stored in the launch tube. At the plenum chamber, an aperture corresponding to each gas-flow channel is initially plugged by a firing pin held in place by a shear pin. Each shear pin is characterized by a unique fault that causes it to fail under a predetermined load. The firing order is determined by the strength of the shear pins from weakest to strongest so that, for example, the weakest shear pin retains the firing pin plugging the channel leading to the forwardmost stored sonobuoy and the strongest shear pin retains the firing pin plugging the channel leading to the last sonobuoy to be launched. When a pneumatic pulse is fed into the plenum chamber from the onboard air supply, the weakest remaining shear pin fails and the firing pin retained thereby is forcibly driven into an impact-responsive squib situated alongside a gas-generating cartridge forward of the firing pin in the gas-flow channel. As the firing pin moves forward in the gas-flow channel, a spring-loaded cap closes off the gas-flow channel at the breech end. The gas dis charged from the gas-generating cartridge travels down the gas-flow channel and forces the corresponding stored sonobuoy out of the launch tube. Subsequent pneumatic pulses cause failure of the remaining shear pins and the process is repeated until the supply of stored sonobuoys is exhausted.

Although single-tube, multi-sonobuoy launch systems are not entirely unprecedented, it will be appreciated that those systems utilizing an expendable launch mechanism (e.g., a gas-generating cartridge) corresponding to each sonobuoy to be launched are somewhat cumbersome and, if they are not to be disposed of, have associated with them a refitting expense. For instance, in the latter example described in the preceding paragraph, firing pins must be removed and shear pins and gas-generating cartridges must be replaced or refilled in order to render the sonobuoy launcher prepared for reuse.

Accordingly, there exists a need for a sonobuoy launch system that, in various implementations, facilitates relatively simple retrofitting of an existing, single-sonobuoy launcher system to enable the sequential launch of multiple sonobuoys from a single tube and that is, furthermore, readily reusable and relatively inexpensive and simple to recondition for use.

SUMMARY

In various alternative embodiments, a pneumatic sonobuoy launcher adapted for simultaneously storing, and sequentially and independently launching, at least two sonobuoys, comprises a barrel including a barrel wall having an inside surface extending longitudinally between a closed back end and an expulsion end. The inside surface defines an interior projectile-guiding channel, the channel being adapted to slidably receive and store multiple (i.e., a plurality of at least two), serially arranged projectiles (i.e., sonobuoys) each of which projectiles, when in a stored position, occupies a distinct region of the channel separated by an interval of space from at least one other region within the barrel. The at least two projectiles include a rearwardmost projectile stored closest to the back end of the barrel and a forwardmost projectile stored closest to the expulsion end of the barrel. In various embodiments, the rearwardmost projectile occupies a region of the channel defined such that there exists a void between the back end of the barrel and the rearwardmost stored projectile.

An expulsion-gas delivery system includes at least one valve selectively connectable into fluid communication with an expulsion-gas supply such as, by way of example, an onboard compressed air supply carried by an aircraft or water-going vessel. The at least one valve is pneumatically switchable from at least (i) a first gas-channeling state in which expulsion gas introduced through the valve from the expulsion-gas supply is directed through a first outbound conduit having a distal end in fluid communication with a first interval between projectiles to (ii) a second gas-channeling state in which expulsion gas introduced into the valve from the expulsion-gas supply is directed through a second outbound conduit having a distal end in fluid communication with at least one of (a) a second interval located to the rear of the first interval and (b) the void behind the rearwardmost projectile.

The pneumatic switching of a valve from the first gas-channeling state to the second gas-channeling state is achieved by a switching-gas channeling system that includes a feedback conduit for communicating pneumatic back pressure created upon the pneumatic expulsion of a projectile to a pneumatically-responsive pilot on the valve. The valves, outbound conduits and feedback conduits of particular embodiments are arranged to facilitate the sequential expulsion of plural projectiles using pneumatic pulses supplied from a single source of pressurized gas. Following the expulsion of all stored sonobuoys, the barrel is reloaded and valve is reset to its original pre-launch position.

In various alternative embodiments, the sonobuoy launcher is a modular adaptor for converting a single-sonobuoy, pneumatic launch tube into a pneumatic launcher having the capacity to simultaneously store, and sequentially and independently launch, at least two sonobuoys. A typical pre-existing single-sonobuoy, pneumatic launch tube suitable for conversation by various implementations has a breech end that is selectively connectable into fluid communication with a source of compressed expulsion gas, a projectile-ejection end opposite the breech end and a wall with an inside surface extending longitudinally between the breech and projectile-ejection ends. Versions of a modular sonobuoy launcher adaptor include a housing defined by a housing wall including interior and exterior surfaces extending between rear and front ends. The housing is adapted for selective insertion into, and retention by, the pre-existing pneumatic launch tube and at least partially houses at least one of a barrel, an expulsion-gas delivery system and a switching-gas channeling system such as those previously described. The housing is, in various versions, generally cylindrical and includes an open front end to accommodate either the extension of the barrel forward thereof or, in versions in which the barrel does not extend beyond the front end, the passage of sonobuoys therethrough. The rear end of the housing may be open or at least partially closed, but typically facilitates the connection of a gas conduit leading from a valve of the expulsion-gas delivery system to an expulsion-gas supply through the rear end of the housing. In various versions, a gas conduit of the expulsion-gas delivery system terminates at a connector adjacent the rear end of the housing. The connector is capable of selective sealing engagement with a port or cooperative connector at the breech end of the pre-existing launch tube such that the source of compressed expulsion gas to which the breech end of the pre-existing launch tube is selectively connectable into fluid communication serves as the expulsion-gas supply for the modular sonobuoy launcher adaptor.

Representative, non-limiting embodiments, and the general operation thereof, are more completely described and depicted in the following detailed description and the accompanying drawings. Although specific embodiments are described and depicted in association with the retrofitting of single-sonobuoy, pneumatic launch tubes, within the scope and contemplation of the invention as expressed in the appended claims are embodiments constituting "standalone" single-tube, multi-sonobuoy launchers and single-tube launchers for sequentially launching projectiles other than sonobuoys.

BRIEF DESCRIPTION OF THE DRAWINGS

FIG. A shows an example of a pre-existing array-type sonobuoy launcher mounted in the side of an aircraft;

FIG. B is a more detailed depiction of the sonobuoy launcher of FIG. A;

Figure 1:
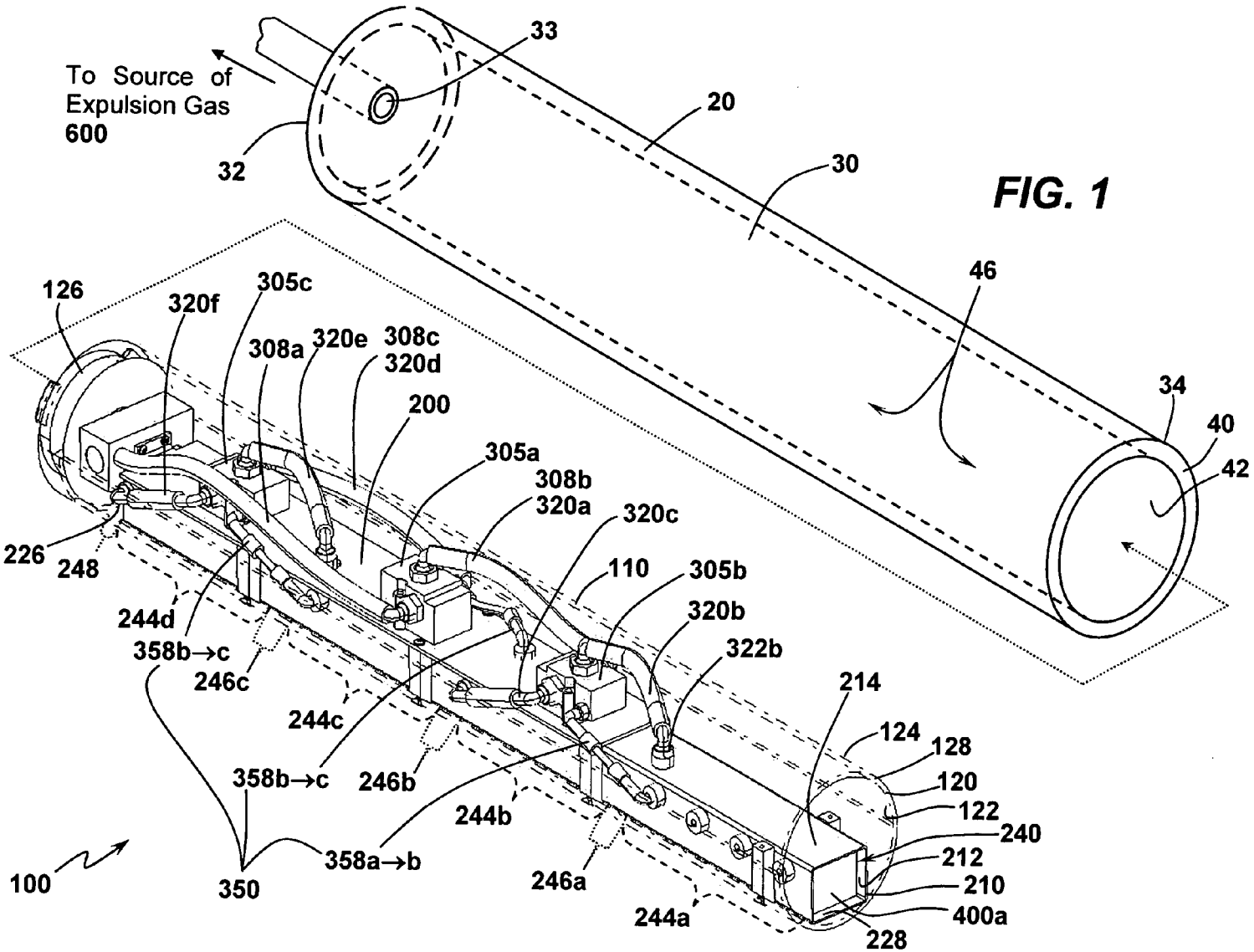
Figure 2:
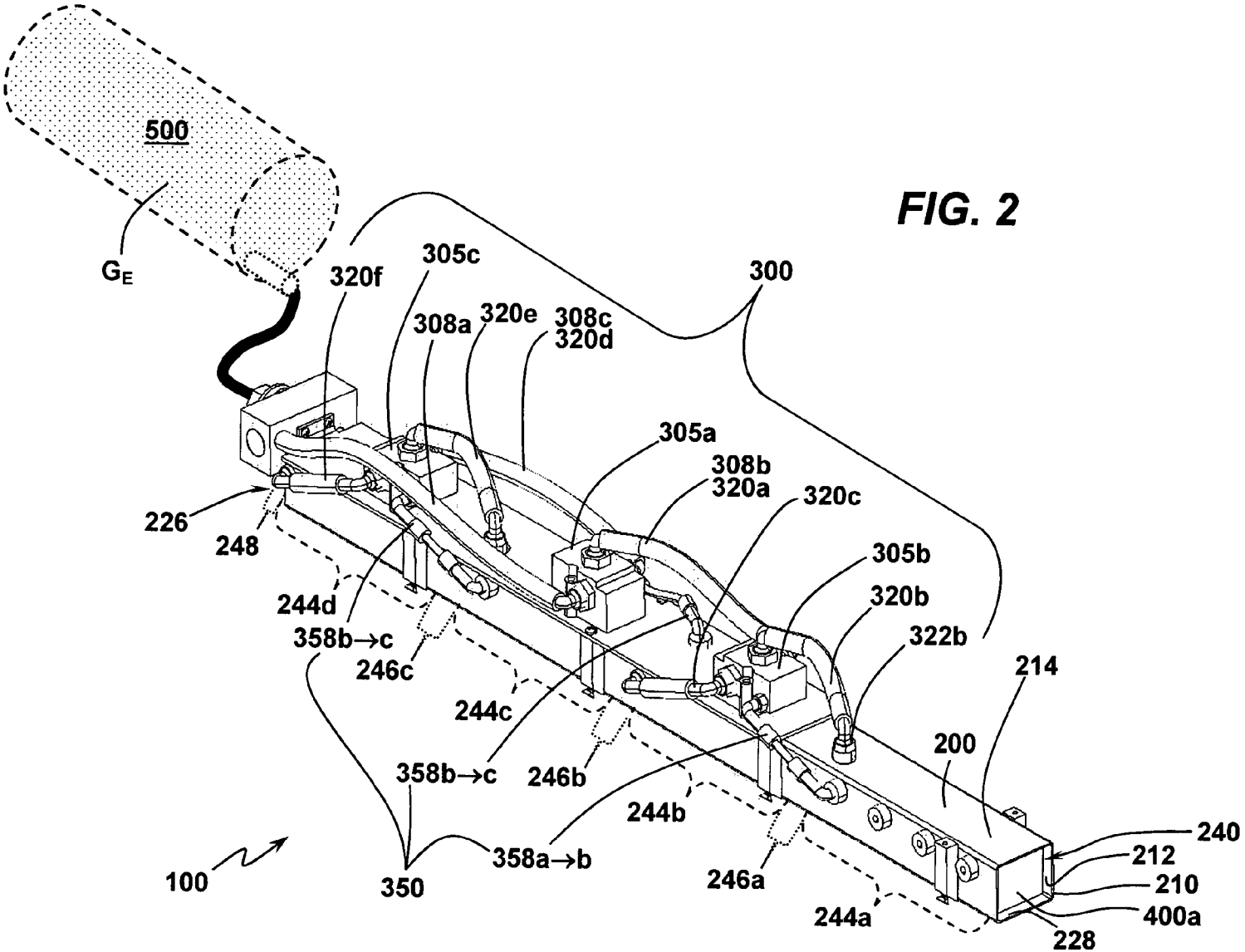

FIG. C shows a launch tube of a type that is held in the array of FIG. B and which is adapted to retain a single sonobuoy;

FIG. 1 depicts an illustrative sonobuoy launcher adaptor including a barrel for storing and sequentially ejecting multiple sonobuoys, an expulsion-gas delivery system and a switching-gas channeling system retained in a housing;

FIG. 2 shows the sonobuoy launcher adaptor of FIG. 1 with the housing removed; and FIGS. 3Ai through 3Dii are cross-sectional, semi-schematic illustrations of a sonobuoy launcher at various stages between a first time previous to the expulsion of the first of four sonobuoys stored therein through a subsequent time during the expulsion of the last-remaining sonobuoy.

DETAILED DESCRIPTION

The following description of various embodiments of a sonobuoy launcher adaptor is illustrative in nature and is therefore not intended to limit the scope of the invention or its application of uses.

Referring to FIG. 1, an illustrative sonobuoy launcher adaptor 100 includes a housing 110 defined by a housing wall 120 including interior and exterior surfaces 122 and 124 extending between rear and front ends 126 and 128. In various embodiments, the housing 110 exhibits dimensions and a geometrical configuration that render it suitable for insertion into, and retention by, the launch tube 30 of a pre-existing sonobuoy launcher 20. For example, the housing 110 may be fabricated so as to exhibit dimensional and geometric properties similar to those of a single sonobuoy of the type the pre-existing launch tube 30 was designed to store and deploy (e.g., the sonobuoy A400 shown in FIG. C). The illustrative pre-existing launch tube 30 of FIG. 1 further includes a breech end 32, a projectile-ejection end 34 opposite the breech end 32 and a cylindrical side wall 40 with an inside surface 42 defining a sonobuoy-retaining cavity 46 extending longitudinally between the breech and projectile-ejection ends 32 and 34. The sonobuoy-retaining cavity 46 is selectively connectable into fluid communication, typically through a gas port 33 through the breech end 32 or through the side wall 40, with a source of compressed expulsion gas 600. With reference to the illustrative pre-existing sonobuoy launcher A20 of FIG. C, it will be appreciated that the housing 110 of the sonobuoy launcher adaptor 100 may be alternatively fabricated to exhibit the dimensional and geometric properties of the launch tube A30. In this latter instance, the housing 110 would be inserted into a launch-tube retainer A25 in the array in place of a launch tube A30.

The housing 110 of the illustrative sonobuoy launcher adaptor 100 of FIG. 1 houses a barrel 200 that is shown in isolation from the housing 110 in FIG. 2. The barrel 200 includes a barrel wall 210 having inside and outside surfaces 212 and 214 extending longitudinally between a closed back end 226 and an open expulsion end 228 through which sonobuoys 400 are selectively ejected. The barrel wall 210 defines an interior projectile-guiding channel 240 that is adapted to slidably receive and store plural (i.e., at least two), serially arranged sonobuoys 400. Each sonobuoy 400, when in a stored position, occupies a distinct region 244 of the projectile-guiding channel 240. Each region 244 is separated by an interval 246 from at least one other region 244 within the barrel 200. Referring to the specific example of FIGS. 1 and 2, and to the semi-schematic, cross-sectional depictions of FIGS. 3Ai through 3Dii, each of four sonobuoys 400*a*, 400*b*, 400*c* and 400*d* occupies a respective one of regions 244*a, b, c* and *d*. For reference purposes, the stored sonobuoy 400*d* closest to the back end 226 of the barrel 200 is regarded as the rearwardmost sonobuoy 400 while the stored sonobuoy 400*a* closest to expulsion end 228 of the barrel 200 is regarded as the forwardmost sonobuoy 400. In addition to there being intervals 246*a, b* and *c* between stored sonobuoys 400, there exists a void 248 between the back end 228 of the barrel 200 and the rearwardmost sonobuoy 400*d*.

Referring to FIG. 2, the sonobuoy launcher adaptor 100 includes an expulsion-gas delivery system 300 that selectively and sequentially channels pressurized gas from a centralized expulsion-gas supply 500 to the spaces behind each of the stored sonobuoys 400, beginning with the forwardmost sonobuoy 400*a*, in order to expel that sonobuoy 400 from the barrel 200 through the expulsion end 228. The sonobuoy launcher adaptor 100 also includes a switching-gas channeling system 350 that cooperates with the expulsion-gas delivery system 300 to facilitate the sequential expulsion of stored sonobuoys 400 in a manner to be more fully described in succeeding paragraphs.

The cooperation of the expulsion-gas delivery system 300 and the switching-gas channeling system 350 of the illustrative launcher adaptor 100 of FIGS. 1 and 2 is now described in association with the sequential expulsion of four sonobuoys 400*a, b, c*, and *d* as depicted in the cross-sectional, semi-schematic depictions in FIGS. 3Ai through 3Dii. It will be appreciated that the specific components and structural arrangements depicted are illustrative only and therefore are not intended to limit the scope of the invention as expressed in the appended claims. The expulsion-gas delivery system 300 includes a first (alternatively referred to as "master") valve 305*a* that is in selectable fluid communication with a supply 500 of expulsion gas $G_E$ through gas-main conduit 308*a*. Pressurized expulsion gas $G_E$ delivered to the master valve 305*a* through gas-main conduit 308*a* is selectively deliverable to a second valve 305*b* and a third valve 305*c* through, respectively, expulsion-gas supply conduits 308*b* and 308*c*. Each of the valves 305*a, b*, and *c* is pneumatically switchable from at least (i) a first gas-channeling state in which expulsion gas $G_E$ introduced through the valve (305*a, b*, or *c* or, generically, 305) from the expulsion-gas supply 500 is directed through a first outbound conduit 320 having a distal end 322 in fluid communication with a first interval 246 between sonobuoys 400, either directly or through another valve 305, to (ii) a second gas-channeling state in which expulsion gas $G_E$ introduced into the valve 305 from the supply 500 is directed through a second outbound conduit 320 having a distal end 322 in fluid communication with one of (a) a second interval 246 located to the rear of the first interval 246 and (b) a location within the channel 240 (e.g., void 248) behind the rearwardmost sonobuoy 400 (i.e., 400*d* in the example depicted). With the expulsion of each sonobuoy 400, switching gas $G_s$ is channeled from the region 244 of the projectile-guiding channel 240 from which the expelled sonobuoy 400 originated through a feedback conduit 358 of the switching-gas channeling system 350 to a valve 305 in order to switch that valve 305 into a state that facilitates the expulsion of that sonobuoy 400 of the remaining stored sonobuoys 400 that is closest to the expulsion end 228 of the barrel 200. The state of each of valves 305*a, b*, and *c* just prior to, and following, the expulsion of each of sonobuoys 400*a, b, c*, and *d* is described below in conjunction with FIGS. 3Ai through 3Dii in which the states of each of valves 305*a, b* and *c* are represented by arrows indicating through which of outbound conduits 320 that valve will channel expulsion gas $G_E$. In various implementations in which the sonobuoy launcher adaptor 100 is retainable within the sonobuoy-retaining cavity 46 of a pre-existing, single-sonobuoy launch tube 30, a valve 305 (e.g., master valve 305*a*) is selectively connectable into fluid communication with the source of compressed expulsion gas 600 through the gas port 33 of the single-sonobuoy, pneumatic launch tube 30 such that the source of compressed expulsion gas 600 with which the sonobuoy-retaining cavity 46 is selectively connectable into fluid communication serves as the expulsion-gas supply 500 for the modular sonobuoy launch adaptor 100.

Referring to FIG. 3Ai, the sonobuoy launcher adaptor 100 is set in a state of readiness to expel sonobuoy 400*a*. In this condition, master valve 305*a* is in a first gas-channeling state in which expulsion gas $G_E$ received into the master valve 305*a* through gas-main conduit 308*a* is blocked from delivery to valve 305*c* and is directed instead for delivery to valve 305*b* through an outbound conduit 320*a* leading from valve 305*a* to an intake port (not labeled) of valve 305*b*. The outbound conduit 320*a* serves as the expulsion-gas supply conduit 308*b* for valve 305*b*. For the expulsion of sonobuoy 400*a*, valve 305*b* is in a first gas-channeling state in which expulsion gas $G_E$ is channeled through an outbound conduit 320*b* having a distal end 322*b* in fluid communication with the first interval 246*a* of the projectile-guiding channel 240 located behind sonobuoy 400*a*. As shown in FIG. 3Aii, as pressurized expulsion gas $G_E$ forces sonobuoy 400*a* toward and through the expulsion end 228 of the barrel 200, a quantity of the expulsion gas $G_E$ (referred to a "switching gas $G_s$") is channeled into a first feedback conduit 358*a*→*b* that provides fluid communication between the first region 244*a* of the projectile-guiding channel 240 and a pneumatically-responsive pilot 306*b* of valve 305*b* in order to switch the valve 305*b* from the first gas-channeling state to a second gas-channeling state. The arcuate arrow in valve 305*b* indicates that valve 305*b* is switching between the first and second gas-channeling states.

It will be appreciated that the pilot 306*b* may actually respond and switch the valve 305*b* before fresh expulsion gas $G_E$ actually reaches the pilot 306*b* because pneumatic back pressure created upon the expulsion of the sonobuoy 400*a* is communicated through gas already present in the feedback conduit 358*a*→*b* by the impingement of pressurized expulsion gas $G_E$ on that already-present gas. Accordingly, the gas already present in the feedback conduit 358*a*→*b* prior to expulsion is, in the context of communicating back pressure to the pilot 306*b*, also referred to as switching gas $G_s$. This observation applies similarly and more generally to the other feedback conduits 358 and pilots 306. Moreover, as will be appreciated by those ordinarily skilled in arts relating generally to pneumatics, the back pressure may, in alternative embodiments, be restricted (or limited) by a device such as a check valve (not shown specifically in the drawings) and this pressure-limiting device may be included as part of the pilot 306 or separately and elsewhere in the feedback conduit 358, for example.

Referring to FIG. 3Bi, the pneumatic switching of valve 305*b* from the first gas-channeling state to the second gas-channeling state sets the sonobuoy launcher adaptor 100 into a state of readiness for the expulsion of sonobuoy 400*b*. With the master valve 305*a* still in the first gas-channeling state, expulsion gas $G_E$ received into the master valve 305*a* through gas-main conduit 308*a* is still channeled to valve 305*b* through outbound conduit 320*a*. However, with valve 305*b* in the second gas-channeling state, expulsion gas $G_E$ received into the valve 305*b* is blocked from passage to the first interval 246*a* through outbound conduit 320*b* and is instead channeled through outbound conduit 320*c* to the second interval 246*b* located to the rear of stored sonobuoy 400*b*. As shown in FIG. 3Bii, as pressurized expulsion gas $G_E$ forces sonobuoy 400*b* toward and through the expulsion end 228 of the barrel 200, a quantity of switching gas $G_s$ is channeled through a second feedback conduit 358*b*→*c* from the second region 244*b* of the projectile-guiding channel 240 to the pneumatically-responsive pilot 306*a* of valve 305*a* in order to switch valve 305*a* from the first gas-channeling state to a second gas-channeling state.

As shown in FIG. 3Ci, with the master valve 305*a* switched to its second gas-channeling state, and valve 305*c* in a first channeling state, the sonobuoy launcher adaptor 100 is set for the expulsion of sonobuoy 400*c*. More specifically, expulsion gas $G_E$ that passes through the master valve 305*a* is channeled for passage through outbound conduit 320*d* leading from the master valve 305*a* and serving as the expulsion-gas supply conduit 308*c* for valve 305*c*. For the expulsion of sonobuoy 400*c*, expulsion gas $G_E$ supplied through supply conduit 308*c* is channeled through outbound conduit 320*e* to the third interval 246*c* of the projectile-guiding channel 240 located behind sonobuoy 400*c*. As shown in FIG. 3Cii, as pressurized expulsion gas $G_E$ forces sonobuoy 400*c* toward the expulsion end 228 of the barrel 200, switching gas $G_s$ is channeled through a third feedback conduit 358*b*→*c* from the third region 244*c* of the projectile-guiding channel 240 to the pneumatically-responsive pilot 306*c* of valve 305*c* in order to switch valve 305*c* from the first gas-channeling state to a second gas-channeling state.

Referring to FIG. 3Di, each of the master valve 305*a* and valve 305*c* is in its second gas-channeling state and the sonobuoy launcher adaptor 100 is set to expel the final sonobuoy 400*d*. As shown in FIG. 3Dii, the expulsion of the final sonobuoy 400*d* is accomplished by the channeling of expulsion gas $G_E$ received by valve 305*c* through outbound conduit 320*f* to a location (i.e., void 248) of the projectile-guiding channel 240 located behind sonobuoy 400*d*.

The intervals 246 between sonobuoys 400 and, where applicable, the void 248 to the rear of the rearwardmost sonobuoy 400, may be defined and maintained by independent spacer elements 420, examples of which are shown between sonobuoys 400*a* and 400*b*, and to the rear of sonobuoy 400*d*, in FIG. 3Ai. Such spacer elements 420 are, in various implementations, fabricated from a lightweight material such as plastic or foam, by way of non-limiting example, so as not to impede the expulsion of sonobuoys 400 or damage the barrel 200. Alternative, more environmentally conscious spacer elements 420 are made from biodegradable material such as paper or corrugated cardboard, for instance. In still additional, alternative implementations, each sonobuoy 400 is fabricated to include, relative to the expulsion direction, at least one of a rearwardly and forwardly projecting protrusion 410*r* and 410*f* to define an interval 246 between itself and an adjacent sonobuoy 400 when loaded into the barrel 200. Illustrative sonobuoys 400*b* and 400*c* in FIG. 3Ai include, respectively, rearwardly and forwardly projecting protrusions 410*r* and 410*f*.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact construction, implementations and versions shown and described.

What is claimed is:

1. A pneumatic sonobuoy launcher adapted for simultaneously storing, and sequentially and independently launching, at least two sonobuoys, the sonobuoys launcher comprising:

a barrel including a barrel wall having an inside surface extending longitudinally between a closed back end and an expulsion end and defining an interior projectile-guiding channel, the channel being adapted to slidably receive and store plural, serially arranged sonobuoys each of which sonobuoys, when in a stored position, occupies a distinct region of the channel separated by an interval of space from at least one other region within the barrel, the plural sonobuoys including a rearwardmost sonobuoy stored closest to the expulsion end of the barrel and a forwardmost sonobuoy stored closet to the expulsion end of the barrel;

an expulsion-gas delivery system including at least one valve selectively connectable into fluid communication with an expulsion-gas supply and pneumatically switchable from at least (i) a first gas-channeling state in which expulsion gas introduced through the valve from the expulsion-gas supply is directed through a first outbound conduit having a distal end in fluid communication with a first interval between sonobuoys to (ii) a second gas-channeling state in which expulsion gas introduced into the valve from the expulsion-gas supply is directed through a second outbound conduit having a distal end in fluid communication with at least one of (a) a second interval located to the rear of the first interval and (b) a location within the channel behind the rearwardmost sonobuoy; and a switching-gas channeling system including a feedback conduit for communicating pneumatic back pressure created upon the pneumatic expulsion of a sonobuoy to at least one of the at least one switchable valves in order to switch that valve from the first gas-channeling state to the second gas-channeling state.

2. The pneumatic sonobuoy launcher of claim 1 wherein the rearwardmost stored sonobuoy occupies a region of the channel defined such that there exists a void between the back end of the barrel and the rearwardmost stored sonobuoy and wherein at least one of the at least one valves has a second gas-channeling state in which expulsion gas introduced into that valve from the expulsion-gas supply is directed to the void behind the rearwardmost stored sonobuoy.

3. The pneumatic sonobuoy launcher of claim 2 wherein the pneumatic sonobuoy launcher is a modular adaptor for converting a single-sonobuoy, pneumatic launch tube having a breech end connectable into fluid communication with a source of compressed expulsion gas, a projectile-ejection end opposite the breech end and a wall extending longitudinally between the breech and projectile-ejection ends into a pneumatic sonobuoy launcher having the capacity to simultaneously store, and sequentially and independently launch, at least two sonobuoys, and wherein the modular sonobuoy launcher adaptor further comprises:

a housing defined by a housing wall including interior and exterior surfaces extending between rear and front ends, the housing furthermore retaining and at least partially housing at least on of the barrel, the expulsion-gas delivery system and the switching-gas channeling system and being adapted for selective insertion into, and retention by, the single-sonobuoy, pneumatic launch tube.

4. The modular sonobuoy launcher adaptor of claim 3 wherein the at least one valve is selectively connectable into fluid communication with the source of compressed expulsion gas through the breech end of the single-sonobuoy, pneumatic launch tube such that the source of compressed expulsion gas to which the breech end is selectively connectable into fluid communication serves as the expulsion-gas supply for the modular sonobuoy launch adaptor.

5. The pneumatic sonobuoy launcher of claim 1 wherein the pneumatic sonobuoy launcher is a modular adaptor for coverting a single-sonobuoy, pneumatic lauch tube having a breech end connectable into fluid communication with a source of compressed expulsion gas, a projectile-ejection end opposite the breech end and a wall extending longitudinally between the breech and projectile-ejection ends into a pneumatic sonobuoy launcher having the capacity to simultaneously store, and sequentially and independently launch, at least two sonobuoy, and wherein the modular sonobuoy launcher adaptor further comprises:

a housing defined by a housing wall including interior and exterior surface extending between rear and front ends, the housing furthermore retaining and at least partially housing at least one of the barrel, the expulsion-gas delivery system and the switching-gas channeling system and being adapted for selective insertion into, and retention by, the single-sonobuoy, pneumatic launch tube.

6. The modular sonobuoy launcher adapted of claim 5 wherein the at least one valve is selectively connectable into fluid communication with the source of compressed expulsion gas through the breech end of the single-sonobuoy, pneumatic launch tube such that the source of compressed expulsion gas to which the breech end is selectively connectable into fluid communication serves as the expulsion-gas supply for the modular sonobuoy launch adaptor.

7. A modular sonobuoy launcher adaptor for converting into a pneumatic launcher having the capacity to simultaneously store, and sequentially and independently launch, at least two sonobuoys from a single-sonobuoy, pneumatic launch tube having a breech end, a projectile-ejection end opposite the breech end and a side wall defining a sonobuoy-retaining cavity extending longitudinally between the breech and projectile-ejection ends and being selectively connectable into fluid communication with a source of compressed expulsion gas through a gas port, the sonobuoy launcher adaptor comprising:

a housing defined by a housing wall including interior and exterior surfaces extending between rear and front ends and adapted for selective insertion into the sonobuoy-retaining cavity of the launch tube for retention thereby;

a barrel retained and at least partially housed by the housing and including a barrel wall having an inside surface extending longitudinally between a closed back end and an expulsion end and defining an interior projectile-guiding channel, the channel being adapted to slidably receive and store plural, serially arranged sonobuoys each of which sonobuoys, when in a stored position, occupies a distinct region of the channel separated by an interval of space from at least one other region within the barrel, the plural sonobuoy, including a rearwardmost sonobuoy stored closest to the back end of the barrel and a forwardmost sonobuoy stored closest to the expulsion end of the barrel;

an expulsion-gas delivery system including at least one valve selectively connectable into fluid communication with an expulsion-gas suppy and pneumatically switchable from at least (i) a first gas-channel state in which expulsion gas introduced through the valve from the expulsion-gas supply is directed through a first outbound conduit having a distal end in fluid communication with a first interval between sonobuoys to (ii) a second gas-channel state in which expulsion gas introduced into the valve from the expulsion-gas supply is directed through a second outbound conduit having a distal end in fluid communication with at least one of (a) a second interval located to the rear of the first interval and (b) a location within the channel behind the rearwardmost sonobuoy; and a switching-gas channeling system including a feedback conduit for communication pneumatic back pressure created upon the pneumatic expulsion of a sonobuoy to at least one of the at least one switchable valves in order to switch that valve from the first gas-channel state to the second gas-channeling state.

8. The modular sonobuoy launcher adaptor of claim 7 wherin the at least one valve is selectively connectable into fluid communication with the source of compressed expulsion gas through the gas port of the single-sonobuoy, pneumatic launch tube such that the source of compressed expulsion gas to which the sonobuoy-retaining cavity is selectively connectable into fluid communication serves as the expulsion-gas supply for the modular sonobuoy launch adaptor.

* * * * *